US006956205B2

(12) United States Patent
Park

(10) Patent No.: US 6,956,205 B2
(45) Date of Patent: Oct. 18, 2005

(54) MEANS AND METHOD FOR GUIDING IONS IN A MASS SPECTROMETER

(75) Inventor: Melvin A. Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

(21) Appl. No.: 09/882,361

(22) Filed: Jun. 15, 2001

(65) Prior Publication Data

US 2004/0149902 A1 Aug. 5, 2004

(51) Int. Cl.[7] ..... H01J 49/00

(52) U.S. Cl. ..... 250/288; 250/281; 250/282; 250/292

(58) Field of Search ..... 250/288, 281, 250/292, 282

(56) References Cited

U.S. PATENT DOCUMENTS

| | | | | |
|---|---|---|---|---|
| 3,723,730 | A | | 3/1973 | Gordon et al. |
| 4,328,420 | A | | 5/1982 | French |
| 4,531,056 | A | | 7/1985 | Labowsky et al. |
| 4,540,884 | A | | 9/1985 | Stafford et al. |
| 4,649,278 | A | | 3/1987 | Chutjian et al. |
| 4,933,551 | A | | 6/1990 | Bernius et al. |
| 4,963,736 | A | | 10/1990 | Douglas et al. |
| 4,977,785 | A | | 12/1990 | Willoughby et al. |
| 5,248,882 | A | | 9/1993 | Liang |
| 5,256,874 | A | | 10/1993 | Chutjian |
| 5,285,064 | A | | 2/1994 | Willoughby |
| 5,291,017 | A | | 3/1994 | Wang et al. |
| 5,374,828 | A | | 12/1994 | Boumsellek et al. |
| 5,381,007 | A | | 1/1995 | Kelley |
| 5,432,343 | A | | 7/1995 | Gulcicek et al. |
| 5,596,193 | A | * | 1/1997 | Chutjian et al. ..... 250/292 |
| 5,652,427 | A | | 7/1997 | Whitehouse et al. |
| 5,668,370 | A | | 9/1997 | Yano et al. |
| 5,670,378 | A | | 9/1997 | Man et al. |
| 5,689,111 | A | | 11/1997 | Dresch et al. |
| 5,750,993 | A | | 5/1998 | Bier |

(Continued)

FOREIGN PATENT DOCUMENTS

| | | |
|---|---|---|
| JP | 1137553 | 5/1989 |
| WO | WO 9938193 | 7/1999 |
| WO | WO 9962101 A1 | 12/1999 |

OTHER PUBLICATIONS

S.A. Shaffer, et al. "A Novel Ion Funnel for Focusing Ions at Elevated Pressure Using Electrospray Ionization Mass Spectrometry," Rapid Commun. Mass Spectrom. 11,1813(1997).

A. Mordehal and S. Buttrill "Proceedings of the 44th ASMS Conference of Mass Spectrometry and Allied Topics, Portland, Oregon," May 12–16, 1996, p. 1172.

A.N. Krutchinsky, "Orthogonal Injection of Matrix–Assisted Laser Desorption/Ionization Ions into a Time–of–Flight Spectrometer through a Collisional Damping Interface." Rapid. Commun. Mass Spectrom. 12,508(1998).

*Primary Examiner*—Nikita Wells
*Assistant Examiner*—Zia R. Hashmi
(74) *Attorney, Agent, or Firm*—Ward & Olivo

(57) ABSTRACT

A multipole ion guide capable of incorporating a plurality of ion sources (i.e., MALDI, ESI, EI/CI, etc.) to provide and analyze ions in a mass analyzer (i.e., ICR, TOF, quadrupole, etc.) has been designed. Such multipole ion guides comprise an array of pairs of parallel conducting rods (i.e., 3 pair, 4 pair, 5 pair, etc.), each pair being equally spaced from one another, with the array being bound on its top and bottom as well as its ends by DC electrodes. The ion guide then utilizes RF/DC potentials to accept ions from any of a multitude of ion sources to facilitate their transmission through differentially pumped regions to a high pressure mass analysis region.

38 Claims, 8 Drawing Sheets

U.S. PATENT DOCUMENTS 5,753,910 A 5/1998 Gourley et al.
5,763,878 A 6/1998 Franzen
5,825,026 A 10/1998 Baykut
5,847,386 A 12/1998 Thomson et al.
5,852,294 A 12/1998 Gulcicek et al.
6,069,355 A 5/2000 Mordehai
6,403,952 B2 * 6/2002 Whitehouse et al. ..... 250/288
6,403,953 B2 * 6/2002 Whitehouse et al. ..... 250/288
6,570,153 B1 * 5/2003 Li et al. ..... 250/292
2002/0121594 A1 * 9/2002 Wang et al.

* cited by examiner

MEANS AND METHOD FOR GUIDING IONS IN A MASS SPECTROMETER

TECHNICAL FIELD OF THE INVENTION

The present invention relates to a method and apparatus for the injection of ions into a mass spectrometer for subsequent analysis. An apparatus for use in an ion source having an ion production means and an ion guide is described which facilitates the transmission of ions from an elevated pressure ion production region to a reduced pressure ion analysis region of a mass spectrometer for mass analysis. Specifically, a preferred embodiment of the present invention allows a multitude of ion production means to simultaneously introduce ions into a single ion guide and transmit the ions to a mass analyzer.

BACKGROUND OF THE PRESENT INVENTION

The present invention relates to multipole ion guides for use in mass spectrometry. The apparatus and methods for ionization described herein are enhancements of the techniques that are referred to in the literature relating to mass spectrometry—an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means and methods exist in the field of mass spectrometry to perform each of these three functions. The particular combination of the means and methods used in a given mass spectrometer determine the characteristics of that instrument.

To mass analyze ions, for example, one might use magnetic (B) or electrostatic (E) analysis. Ions passing through a magnetic or electrostatic field will follow a curved path. In a magnetic field the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), and the quadrupole ion trap analyzers. The analyzer which accepts ions from the ion guide described here may be any of a variety of these.

Before mass analysis can begin, however, gas phase ions must be formed from sample material. If the sample material is sufficiently volatile, ions may be formed by electron ionization (EI) or chemical ionization (CI) of the gas phase sample molecules. For solid samples (e.g., semiconductors, or crystallized materials), ions can be formed by desorption and ionization of sample molecules by bombardment with high energy particles. Secondary ion mass spectrometry (SIMS) , for example, uses keV ions to desorb and ionize sample material. In the SIMS process a large amount of energy is deposited in the analyte molecules. As a result, fragile molecules will be fragmented. This fragmentation is undesirable in that information regarding the original composition of the sample (e.g., the molecular weight of sample molecules) will be lost.

For more labile, fragile molecules, other ionization methods now exist. The plasma desorption (PD) technique was introduced by Macfarlane et al. in 1974 (Macfarlane, R. D.; Skowronski, R. P.; Torgerson, D. F., *Biochem. Biophys. Res Commoun.* 60 (1974) 616). Macfarlane et al. discovered that the impact of high energy (MeV) ions on a surface, like SIMS would cause desorption and ionization of small analyte molecules. However, unlike SIMS, the PD process results also in the desorption of larger, more labile species (e.g., insulin and other protein molecules).

Lasers have been used in a similar manner to induce desorption of biological or other labile molecules. See, for example, VanBreeman, R. B.: Snow, M.: Cotter, R. J., *Int. J. Mass Spectrom. Ion Phys.* 49 (1983) 35; Tabet, J. C.; Cotter, R. J., *Anal. Chem.* 56 (1984) 1662; or Olthoff, J. K.; Lys, I.: Demirev, P.: Cotter, R. J., *Anal. Instrument.* 16 (1987) 93. Cotter et al. modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (Tanaka, K.; Waki, H.; Ido, Y.; Akita, S.; Yoshida, Y.; Yoshica, T., *Rapid Commun. Mass Spectrom.* 2 (1988) 151 and Karas, M.; Hillenkamp, F., *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process, MALDI, is typically used in conjunction with time-of-flight mass spectrometry (TOFMS) and can be used to measure the molecular weights of proteins in excess of 100,000 daltons.

Atmospheric pressure ionization (API) includes a number of methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. Very large ions can be formed in this way. Ions as large as 1 MDa have been detected by ESI in conjunction with mass spectrometry (ESMS).

For example, FIG. 1 depicts a conventional mass spectrometer using an ESI ion source. As shown, ions are introduced into ionization chamber via spray needle 10. At the end of spray needle 10, the solution is formed into a spray 12 of fine droplets. Spray 12 is formed as a result of an electrostatic field applied between spray needle 10 and sampling orifice 14. Sampling orifice 14 may be an aperture, capillary (shown), or other similar inlet leading into vacuum chamber 4 of the mass spectrometer. While in the ionization chamber 2, electrosprayed droplets evaporate thereby producing gas phase analyte ions. In addition, heated drying gas may be used to assist the evaporation of the droplets. The analyte ions are carried with the gas from ionization chamber 2 through the sampling orifice 14 and into the differential pumping system of the mass spectrometer, comprising vacuum chambers 4, 6 & 8 and pumps 20, 22, & 24. With the assistance of electrostatic lens 16 and a conventional ion guide 18, sample analyte ions pass through the vacuum system of the source (i.e., regions 4 & 6) before entering high vacuum region 8 wherein the mass analyzer (not shown) is positioned. Once in the mass analyzer, the sample ions are analyzed to produce a mass spectrum. Some of the analyzers which may be used in such a system include quadrupole, ICR, TOF, etc.

In addition to ESI, any other ion production method that can be adapted to atmospheric pressure might be used. For example, MALDI has recently been adapted by Victor Laiko and Alma Burlingame to work at atmospheric pressure (Atmospheric Pressure Matrix Assisted Laser Desorption Ionization, poster #1121, $4^{th}$ International Symposium on Mass Spectrometry in the Health and Life Sciences, San Francisco, Aug. 25–29, 1998) and by Standing et al. at elevated pressures (Time of Flight Mass Spectrometry of Biomolecules with Orthogonal Injection+Collisional Cooling, poster #1272, $4^{th}$ International Symposium on Mass Spectrometry in the Health and Life Sciences, San Francisco, Aug. 25–29, 1998; and Orthogonal Injection TOFMS *Anal. Chem.* 71(13), 452A (1999)). The benefit of adapting ion sources in this manner is that the ion optics and mass spectral results are largely independent of the ion production method used.

An elevated pressure ion source always has an ion production region (wherein ions are produced) and an ion transfer region (wherein ions are transferred through differential pumping stages and into the mass analyzer). The ion production region is at an elevated pressure—most often atmospheric pressure—with respect to the analyzer. The ion production region will often include an ionization "chamber" (e.g. FIG. 1, ionization chamber 4). In an ESI source, for example, liquid samples are "sprayed" into the "chamber" to form ions.

Once the ions are produced, they must be transported to the vacuum for mass analysis. Generally, mass spectrometers (MS) operate in a vacuum between $10^{-4}$ and $10^{-10}$ torr depending on the type of mass analyzer used. In order for the gas phase ions to enter the mass analyzer, they must be separated from the background gas carrying the ions and transported through the single or multiple vacuum stages.

The use of multipole ion guides has been shown to be an effective means of transporting ions through a vacuum system. Publications by Olivers et al. (Anal. Chem, Vol. 59, p. 1230–1232, 1987), Smith et al. (Anal. Chem. Vol. 60, p. 436–441, 1988) and Douglas et al. U.S. Pat. No. 4,963,736 (Douglas) have reported the use of AC-only quadrupole ion guides to transport ions from an API source to a mass analyzer. Such multipole ion guides may be configured as collision cells capable of being operated in RF only mode with a variable DC offset potential applied to all rods. Thomson et al., U.S. Pat. No. 5,847,386 (Thomson) also describes a quadrupole ion guide. The ion guide of Thomson is configured to create a DC axial field along its axis to move ions axially through a collision cell, inter alia, or to promote dissociation of ions (i.e., by Collision Induced Dissociation (CID)).

Other schemes are available utilizing both RF and DC potentials in order to facilitate the transmission of ions of a certain range of m/z values. For example, in H. R. Morris et al., High Sensitivity Collisionally Activated Decomposition Tandem Mass Spectrometry on a Novel Quadrupole/Orthogonal Acceleration Time-of-Flight Mass Spectrometer, *Rapid Commun. Mass Spectrom.* 10, 889 (1996) (Morris), uses a series of multipoles in their design, one of which is a quadrupole which is capable of being operated in a "wide bandpass" mode or a "narrow bandpass" mode. In the wide bandpass mode, an RF-only potential is applied to the quadrupole and ions of a relatively broad range of m/z values are transmitted. In narrow bandpass mode both RF and DC potentials are applied to the quadrupole such that ions of only a narrow range of m/z values are selected for transmission through the quadrupole. In subsequent multipoles the selected ions may be activated towards dissociation. In this way, the instrument of Morris is able to perform MS/MS experiments with the first mass analysis and subsequent fragmentation occurring in what would otherwise be simply a set of multipole ion guides.

Further, mass spectrometers similar to that of Whitehouse et al. U.S. Pat. No. 5,652,427 (Whitehouse), entitled "Multipole Ion Guide for Mass Spectrometry", use multipole RF ion guides to transfer ions from one pressure region to another in a differentially pumped system. In the source of Whitehouse, ions are produced by ESI or APCI at substantially atmospheric pressure. These ions are transferred from atmospheric pressure to a first differential pumping region by the gas flow through a glass capillary. Ions are transferred from this first pumping region to a second pumping region through a "skimmer" by an electric field between these regions as well as gas flow. A multipole in the second differentially pumped region accepts ions and guides them through a restriction and into a third differentially pumped region. This is accomplished by applying AC and DC voltages to the individual poles.

A four vacuum stage ES/MS quadrupole mass spectrometer according to Whitehouse, incorporating a multipole ion guide beginning in one vacuum pumping stage and extending contiguously into an adjacent pumping stage, is depicted in FIG. 2. As discussed above, ions are formed from sample solution by an electrospray process when a potential is applied between spray needle 27 of sprayer 26 and sampling orifice 38. According to the prior art system shown in FIG. 2, capillary 60 is used to transport ions from atmospheric pressure region 28, where the ions are formed, to first pumping region 30. Lenses 62 and 56 are used to guide the ions from exit end 40 of capillary 60 to a fourth pumping region 36 containing a mass analyzer. In this case, a reflectron TOF mass analyzer is shown. Between lenses 62 and 48, RF only hexapole ion guide 42 is used to guide ions through differential pumping stages 32 and 34 to exit end 46 of ion guide 42 and into mass analysis region 36 through orifice 50. The hexapole ion guide 42 according to this prior art design is intended to provide for the efficient transport of ions from one location (i.e., the entrance 58 of skimmer 56) to a second location (i.e., orifice 50). FIG. 2 is a diagram of a four vacuum pumping stage orthogonal pulsing API/MS system with a reflectron Time-Of-Flight mass analyzer. For the purpose of illustration, an electrospray ion source is shown as the API source. This could alternatively be an APCI or an ICP source. Sample bearing liquid is introduced through the electrospray needle 26 and is electrosprayed (with or without pneumatic assistance) into chamber 28 as it exits the needle at 27. The charged droplets produced evaporate and desorb gas phase ions both in chamber 28 and as they are swept into the vacuum of a mass spectrometer through the annulus in capillary 60. A portion of the ions that enter the first vacuum stage 30 through the capillary exit 40 are focused through the orifice 58 in skimmer 56 with the help of lens 62 and the potential set on the capillary exit 40. Ions passing through skimmer orifice 58 enter the multipole ion guide 42 which begins in vacuum pumping stage 32 and extends unbroken into vacuum stage 34. If the multipole ion guide AC and DC voltages are set to pass ions falling within a range of m/z then ions within that range which enter the multipole ion guide will exit at 46 and are focused with exit lens 48 through the TOF analyzer entrance orifice 50. This primary ion beam 82 passes between electrostatic lenses 64 and 68 located in the fourth pumping stage 36. The relative voltages on lenses 64, 68 and 70 are pulsed so that a portion of the ion beam 82 falling in between lenses 64 and 68 is ejected as a packet through grid lens 70 and accelerated down flight tube 80. The ions are steered by x and y lens sets diagrammatically illustrated by 72 as they continue moving down flight tube 80. As shown in this illustrative configuration, the ion packet is reflected through a reflectron or ion mirror 78 and detected at detector 74. As a pulsed ion packet proceeds down flight tube 80, ions with different m/z separate in space due to their velocity differences and arrive at the detector at different times. The use of orthogonal pulsing in an API/TOF system helps to reduce the ion energy spread of the initial ion packet allowing for the achievement of higher resolution and sensitivity. Also disclosed by Whitehouse is the use of collisional gas within hexapole ion guide 42 to cool the ions to thermal velocities through collisional cooling.

In the scheme of Whitehouse, an RF only potential is applied to multipole ion guide 42. As a result, ion guide 42 is not "selective" but rather transmits ions over a broad range of mass-to-charge (m/z) ratios. Such a range as provided by prior art multipoles is inadequate for certain applications, such as for Matrix Assisted Laser Desorption/Ionization (MALDI), because the ions produced may be well out of this m/z range. In other words, high m/z ions such as are often produced by the MALDI ionization method are often out of the range of transmission of conventional multipole ion guides.

Thus, electric voltages usually applied to the conventional ion guide are used to transmit ions from an entrance end to an exit end. Analyte ions produced in the ion production region pass through a capillary or other ion transfer device to move the ions to a differentially pumped region and enter the ion guide at the entrance end. Through collisions with gas in the ion guide, the kinetic energy of the ions is reduced to thermal energies. Simultaneously, the RF potential on the poles of the ion guide forces ions to the axis of the ion guide. Then, ions migrate through the ion guide toward its exit end, where the ions typically either enter a second ion guide or enter the mass analysis region.

Whitehouse also discloses use of two or more ion guides in consecutive vacuum pumping stages to allow different DC and RF values. However, losses in ion transmission efficiency may occur in the region of static voltage lenses between ion guides. For example, a commercially available API/MS instrument manufactured by Hewlett Packard incorporates two skimmers and an ion guide. The drag stage of a conventional turbo pump is used to pump the region between the skimmers. That is, an additional pumping stage/region is added without the addition of an extra turbo pump, and therefore, improved pumping efficiency may be achieved. In this dual skimmer design, there is no ion focusing device between skimmers, therefore ion losses may occur as the gases are pumped away. A second example is demonstrated by a commercially available API/MS instrument manufactured by Finnigan which applies an electrical static lens between capillary and skimmer to focus the ion beam. Due to narrow mass range of the static lens, the instrument may need to scan the voltage to optimize the ion transmission.

In addition, the electrode rods of the prior art multipole ion guides described above are positioned in parallel and are equally spaced at a common radius from the centerline of the ion guide. Thus, ions with a m/z ratio falling within the ion guide stability window established by the applied voltages have stable trajectories within the ion guide's internal volume bounded by the parallel, evenly spaced rods. This is true for quadrupoles, hexapoles, etc. For example, FIGS. 3A & 3B depict a prior art hexapole ion guide 88. Ion guide 88 shown comprises six conducting rods 86 aligned in parallel and adjacent to one another to form a cylinder-like structure. That is, six parallel conducting rods 86 are evenly spaced from centerline 90 (or axis) of ion guide 88. At either end of ion guide 88 are positioned DC electrodes—skimmer 84 at entrance end 92 and gate electrode 89 at exit end 94.

During operation, DC potentials are applied to each of skimmer 84 and gate electrode 89 of multipole ion guide 88 (shown is a hexapole). At skimmer 84 (i.e., entrance end 92 of ion guide 88), ions pass from an ion source region (not shown) through electrically conducting skimmer 84 into the region between the parallel conducting rods 86. In other words, the DC potential applied to skimmer 84 is set such that the ions are focused into ion guide 88. Next, a high voltage RF potential is applied to conducting rods 86 of ion guide 88 to "force" the ions (or focus the ions) to centerline 90 (or axis) of the ion guide. In addition, a collisional gas has been used within such ion guides to collisionally cool the ions therein. Next, the ions will migrate toward exit end 94 of ion guide 88, and at exit end 94 gate electrode 89 is positioned such that a repulsive DC potential may be applied to trap the ions within ion guide 88 until it is time to analyze the ions. On the other hand, when a non-repulsive DC potential is applied to gate electrode 89, the ions may pass freely out of ion guide 88 and into a mass analyzer.

In sum, previous ion guides (e.g., quadrupoles, hexapoles, etc.) have comprised parallel conducting rods evenly spaced from a centerline, having DC electrodes positioned at their entrance and exit ends, and high voltage RF and DC potentials are applied thereto to focus, transmit, and/or trap ions. It has been observed that such ion guides are limited in their applications. Specifically, such conventional ion guides may only accept ions from a single ion production means and changing from one ion production means to another is cumbersome and time consuming. In addition, prior art ion guides are often inadequate for transmission of ions produced by the MALDI method, as these ions are often of a m/z range out of the range for which the ion guides are capable. Yet another disadvantage of prior art ion guides is their limited use for mass selection and performing chemical reactions. As discussed below, the ion guide of the present invention overcomes these limitations and/or deficiencies in conventional ion guides.

SUMMARY OF THE INVENTION

The present invention provides an ion guide for use in a mass spectrometer to facilitate the transmission of ions from an elevated pressure ion production region to a reduced pressure ion analysis region. It is one aspect of the invention to utilize multiple ion production means simultaneously to transmit ions into an analyzer. It is another aspect of the invention that embodiments can be interfaced to atmospheric pressure ion sources, including Electrospray (ESI) and electron ionization/chemical ionization (EI/CI). Embodiments of the present invention can be configured in any variety of hyphenated or non-hyphenated analyzer.

The invention, as described below, includes a number of embodiments. For instance, the invention can be applied to multipole ion guides with any number of poles, and any geometry. It can utilize multiple ion production means of many different types at the same time, and does not even need to accept ions directly from the ion production means. Also, the analyzer may be any of a variety of hyphenated or non-hyphenated analyzers. The ion guide is positioned between the ion production means and the mass analyzer. However, the ion guide does not need to accept ions directly from the ion production means. In another embodiment of the invention, ions may pass through some other device before entering the ion guide. For example, ions might be produced by an ESI ion production means and be analyzed by ion mobility spectroscopy before entering the ion guide. In the preferred embodiment of the invention as shown in FIG. 6, the ion guide serves as an efficient means for transferring ions through one or more pumping vacuum stages between one or more ion production means and the mass analyzer.

In the preferred embodiment of the invention, though, the ion guide need not be planar in cross section as shown in FIG. 4B. Rather, the rods could be arranged to form arcs, or any other useful geometry. Also, the rods could be assembled as a metal deposition (e.g., a vapor deposition) on the insulator. For example, rods might be formed as a gold vapor deposit on two substantially planar ceramic plates. In such a preferred embodiment, the ceramic plates might be produced, for example, with threaded mounting holes such that the plates can be mounted adjacent to one another in an instrument. The ceramic plates might also have vent holes for allowing gas within the ion guide to pass out of the ion guide and into a pump.

As shown in FIG. 5, it is possible to use the ion guide of the present invention with any number of ion production means (either all being the same type of ion production means or each being a different type of ion production means) including Electrospray 39, EI/CI 40 and MALDI 38. Apertures perpendicular to the axis of the ion guide—i.e. the axis of the rods—are used to pass laser light 400 to the MALDI target 38, and subsequently, the MALDI is produced ions from the target 38 to the ion guide 30. A multitude of ion production means could be used simultaneously with the present invention.

The analyzer which accepts ions from the ion guide may also be of a variety of analyzers. These may be hyphenated or non-hyphenated analyzers—e.g., a time-of-flight mass analyzer (TOFMS), a quadrupole, a quadrupole ion trap, a Fourier transform ion cyclotron resonance mass analyzer (FT-ICRMS), or an ion mobility spectrometer (IMS).

The multipole ion guide is configured to perform many functions including, but not limited to m/z selection, trapping and subsequent ion fragmentation using collision induced dissociation (CID) within the multipole ion guide. Ion selection by m/z is possible by adjusting the DC and RF potentials and the RF frequency on the rods. Gas phase chemical reactions can also be carried out in the invention described. For example, ESI ions may be trapped in the ion guide, and then neutral reactant gas leaked into the guide.

In the present invention, multipole ion guides are configured so that ions from a multitude of ion production means can simultaneously be introduced into a single ion guide and transmitted into an analyzer. The ion guide described here can be configured with four (quadrupole), six (hexapole), eight (octapole) or more rods or poles. It is not required that there be a specific entrance point. Rather, there can be a multitude of entrances. Because the present invention allows for a multitude of entrances, a multitude of ion production means can be used simultaneously.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Figure 1:
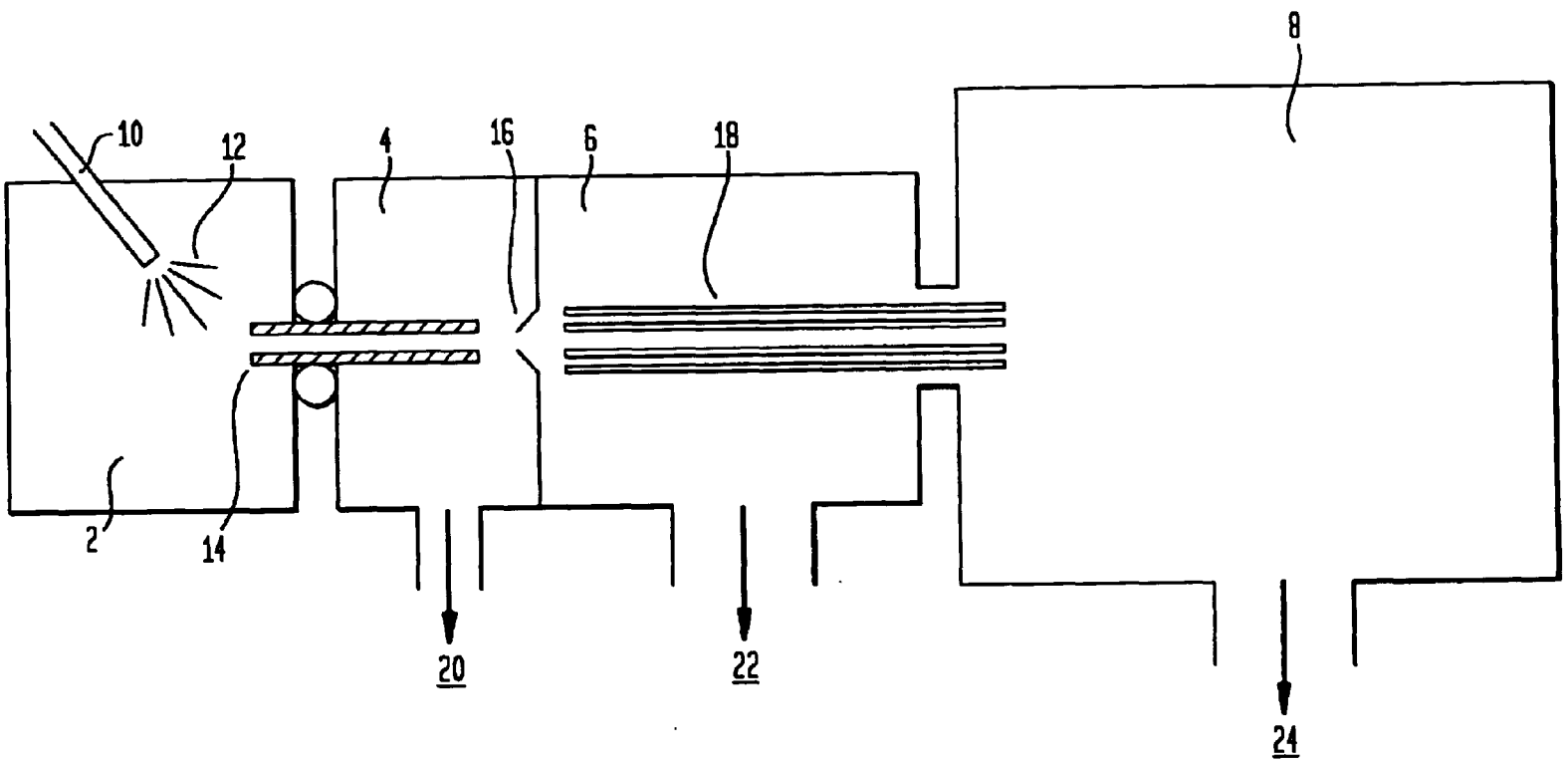
FIG. 1 (PRIOR ART)
FIG. 1 depicts a prior art mass spectrometer using an ESI ion source.
Figure 2:
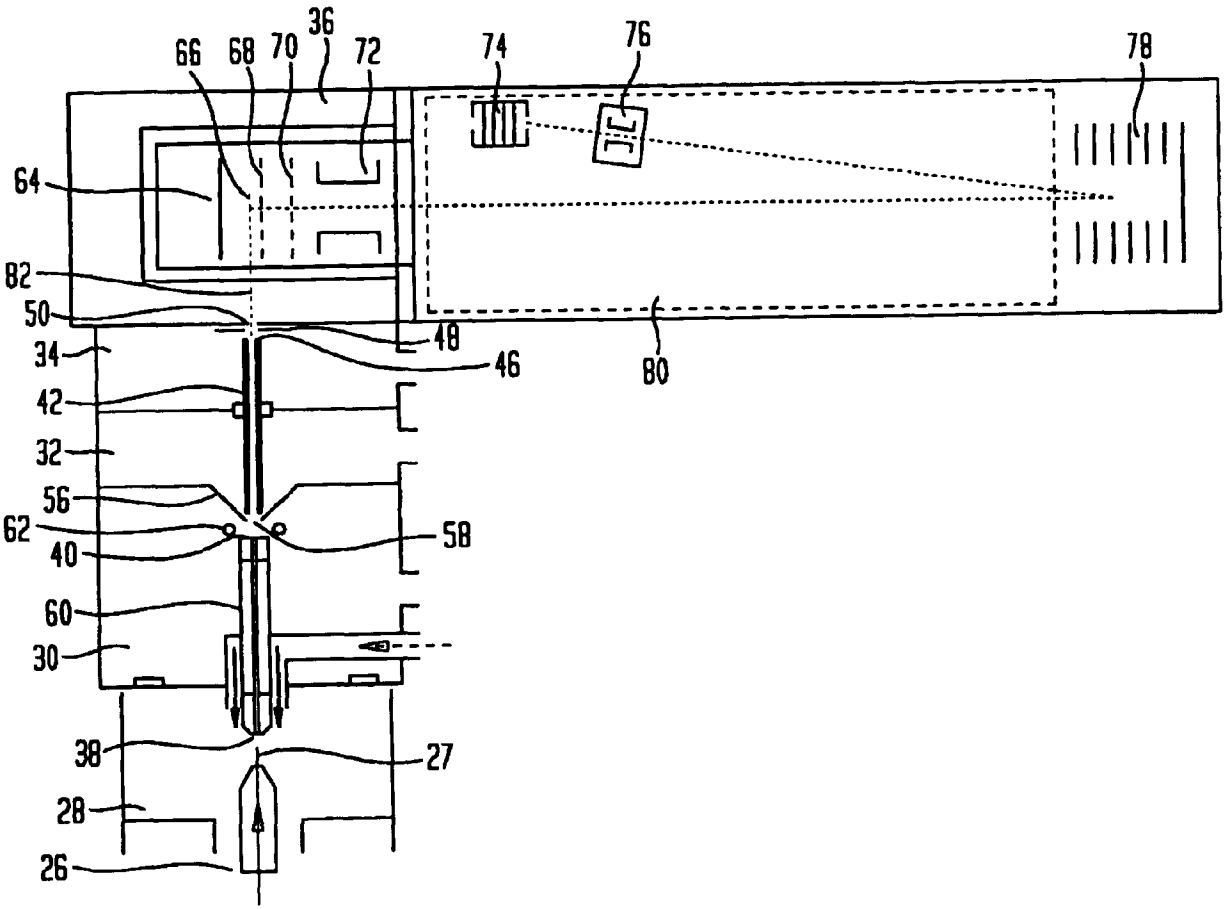
FIG. 2 (PRIOR ART)
FIG. 2 shows a prior art four vacuum stage ES/MS quadrupole mass spectrometer having a multipole ion guide according to Whitehouse et al. U.S. Pat. No. 5,652,427.
Figure 3B:
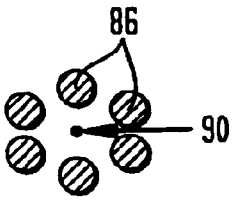
FIG. 3B (PRIOR ART)
FIG. 3B shows a cross-sectional view at line A—A of the prior art hexapole shown in FIG. 3A.
Figure 3A:
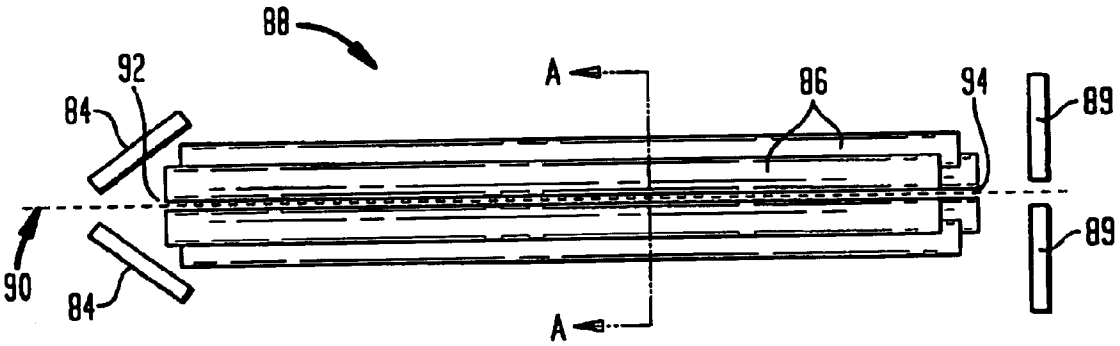
FIG. 3A (PRIOR ART)
FIG. 3A depicts a prior art hexapole ion guide.
Figure 4B:
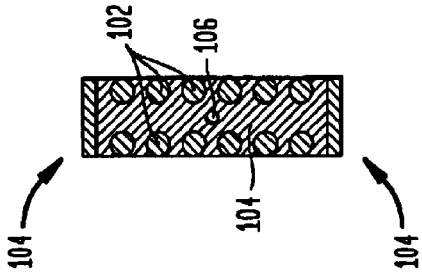
FIG. 4B shows a cross-sectional view at line B—B of the multipole ion guide shown in FIG. 4A.
Figure 4A:
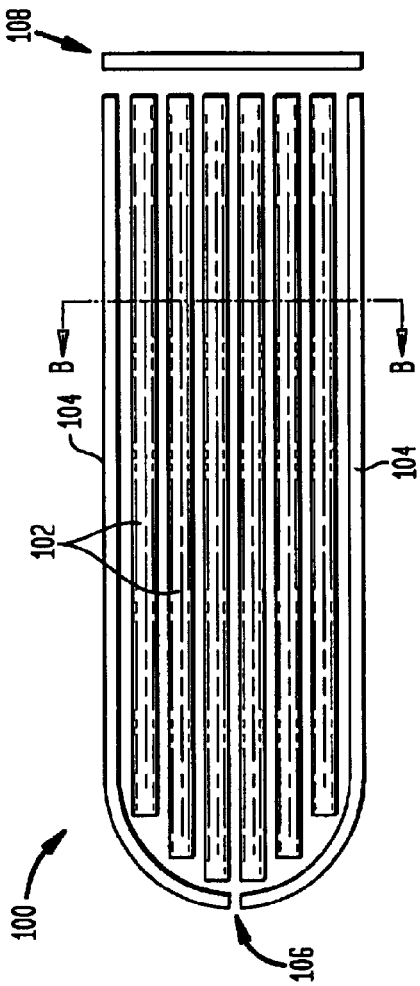
FIG. 4A shows the preferred embodiment of the multipole ion guide according to the present invention.
Figure 4C:
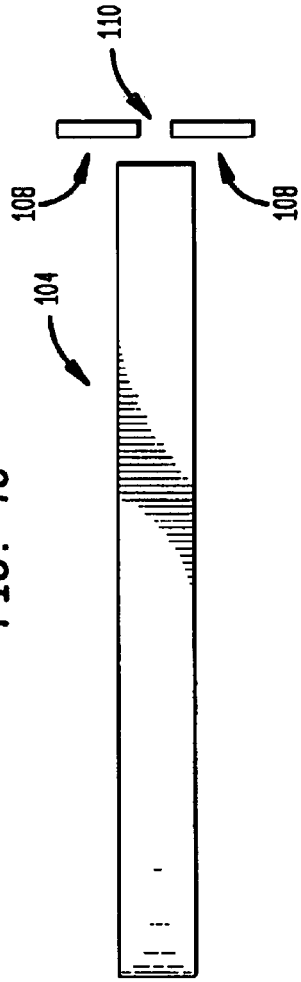
FIG. 4C shows a top plan view of the multipole ion guide shown in FIG. 4A.

Referring first to FIGS. 4A–4C, shown is the preferred embodiment of the multipole RF-DC ion guide according to the present invention. As depicted, multipole ion guide 100 preferably comprises six pairs of parallel conducting rods 102, capping electrodes 104 & 105, and gate electrode 108. Of course, any number of pairs of parallel conducting rods 102 may be used (e.g., 3,4,5,6, etc.). As shown, each pair of conducting rods 102 are preferably arranged such that they are equally spaced from one another (or parallel and equidistant from a central long axis). In an alternative embodiment, conducting rods 100 may be arranged in parallel, but not equally spaced from one another. In yet another alternate embodiment, the pairs of conducting rods 102 may be positioned such that rods 102 form arcs (i.e., the spacing between rods 102 in a given pair is greater for rods 102 in the center of ion guide 100 than rods 102 at its upper and lower edges). Preferably, rods 102 all have different lengths such that at one end of the ion guide 100 all of rods 102 end approximately in a single plane enabling ion guide 100 to be "capped" at this end by a planar (or flat) end capping electrode 108.

Similarly, ion guide 100 is capped longitudinally on its top and bottom by capping electrodes 104 and 105, respectively. Again, capping electrodes 104 and 105 are substantially planar (or flat) conductive electrodes, but because conducting rods 102 are preferably of different lengths, having a first end approximately in a single plane, ion guide 100 preferably has conducting rods 102 forming a second end not in a single plane. That is, conducting rods 102 at the center of ion guide 100 are preferably longest, with conducting rods 102 progressively getting shorter towards the top and bottom edges of ion guide 100. Preferably, conducting rods 102 are of such lengths that when positioned in parallel, a side view of ion guide 100 depicts the second end of rods 102 forming a generally semicircular shape. In such an embodiment, top and bottom capping electrode 104 has a generally curved portion which conforms to the shape of the second end of ion guide 100 formed by conducting rods 102. Of course, top and bottom capping electrode 104 is such that opening 106 remains at the second end of ion guide 100 for introduction of the ions into ion guide 100. Specifically, the entrance end of ion guide 100, top and bottom capping electrode 104 extends continuously around the second end of conducting rods 102.

Figure 8:
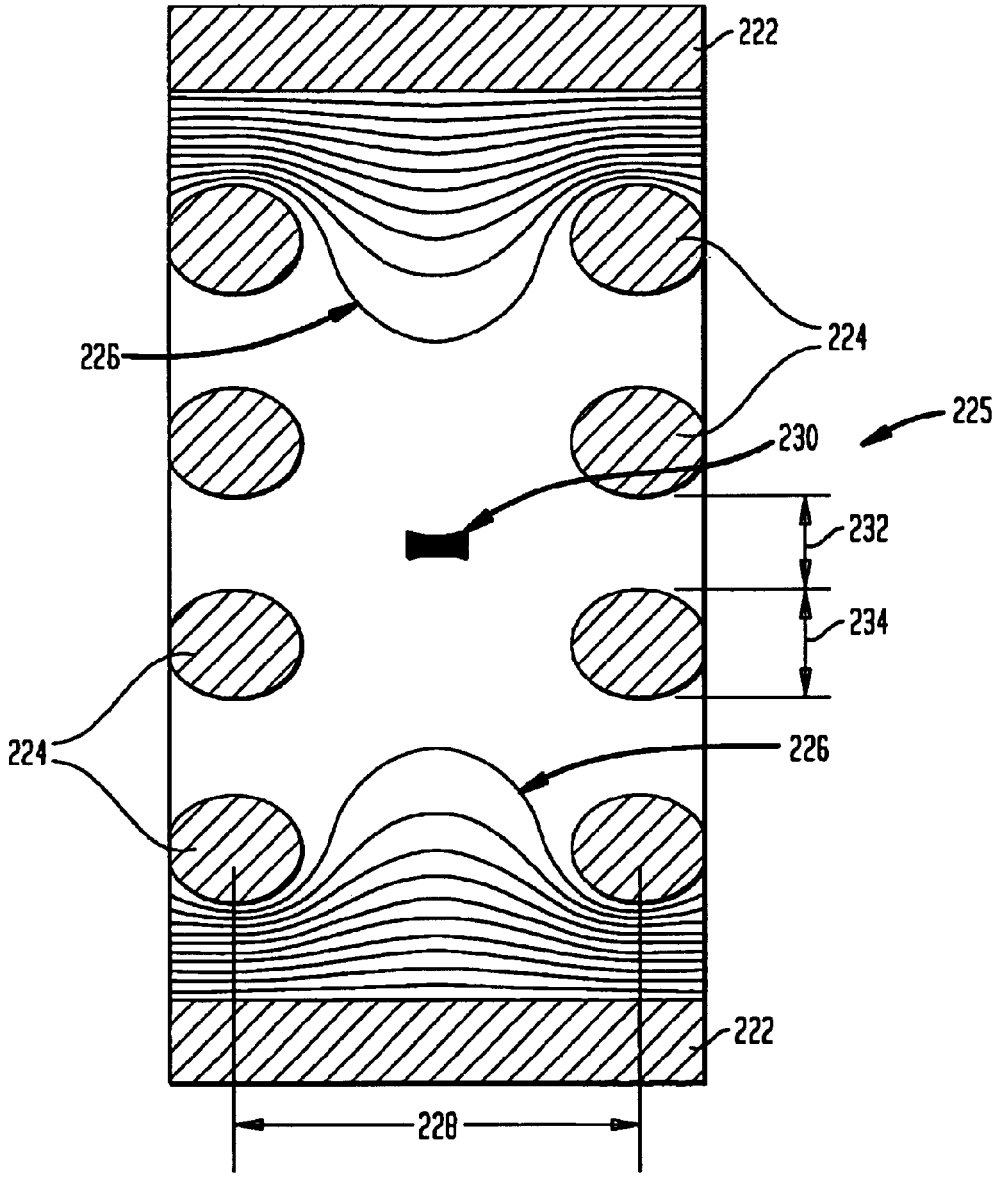
FIG. 8 shows a simulation of an ion trajectory under certain conditions in an RF-DC ion guide according to the present invention.

For example, sample ions enter ion guide 100 through aperture (or opening) 106 and exit ion guide 100 through exit electrode 108. Preferably, high voltage RF potentials are applied between conducting rods 102, with top and bottom capping electrode 104 being held at a repulsive DC potential to "force" the ions toward the center of ion guide 100. As shown in FIG. 8, which depicts a simulated ion trajectory in an ion guide according to the present invention, application of optimum potentials to capping electrodes 222 and conducting rods 224 focus ions to the center 230 of ion guide 225. In the simulation depicted, the following parameters were used: conducting rods 224 were 0.9 mm in diameter (234), vertically spaced (232) 0.75 mm apart and horizontally spaced (228) 3.0 mm apart; a potential of 10 volts was applied to capping electrodes 222; and a potential of 600 volts (peak to peak) was applied to conducting rods 224. As shown, the net effect of the application of these potentials on capping electrodes 222 and conducting rods 224 is the creation of electric fields (depicted as equipotential lines 226) which force the ions toward the center 230 of ion guide 225. Under these conditions, the energy of the ions at center 230 of ion guide 225 is defined as 100 Da/q or 1 eV. In addition, the potential established at center 230 is 0.18 volts while the potential at equipotential line 226 nearest center 230 is 0.9 volts, thereby establishing a net effect of forcing the ions to the region having a lower potential—center 230 of ion guide 225.

Turning next to FIG. 4B, shown is a cross-sectional view at line A—A of ion guide 100. In particular, shown in FIG. 4B is the preferred parallel arrangement of conducting rods 102. As depicted, each pair of conducting rods 102 are preferably equally spaced from one another, and the rods in each pair are spaced apart the same distance as each other pair. Optionally, however, the rods in each pair may be spaced apart at varying distances as each other pair, thereby forming a generally curved (or arched) structure (not shown). Also, FIG. 4B demonstrates the continuous structure of capping electrode 104, only having opening 106 to allow introduction of the ions into ion guide 100.

Next, FIG. 4C shows a top plan view of ion guide 100. As shown in FIG. 4C, ion guide 100 has at its exit end gate electrode 108, gate electrode 108 preferably comprising an opening (or aperture) for allowing ions to pass out of ion guide 100 when gate electrode 108 is deenergized. Alternatively, gate electrode 108 may comprise a grid electrode. Preferably, gate electrode 108 comprises two parallel electrodes spaced apart such that ions may pass there through when the electrodes are deenergized. Alternatively, gate electrode 108 may be a planar electrode at a repulsive DC potential until such time that the ions are to be released from ion guide 100 to the next stage of the mass spectrometer (i.e., the mass analyzer). Repulsion of the ions from the DC potentials on top and bottom capping electrode 104 and gate electrodes 108 in conjunction with the RF potential applied to conducting rods 102 may be used to trap ions within ion guide 100 for any length of time (i.e., to allow for sufficient cooling of the ions, to better focus the ions, etc.) prior to entering the mass analyzer.

Figure 5B:
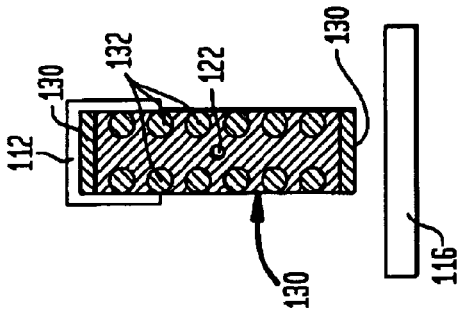
FIG. 5B shows a cross-sectional view at line C—C of the multipole ion guide shown in FIG. 5A.
Figure 5A:
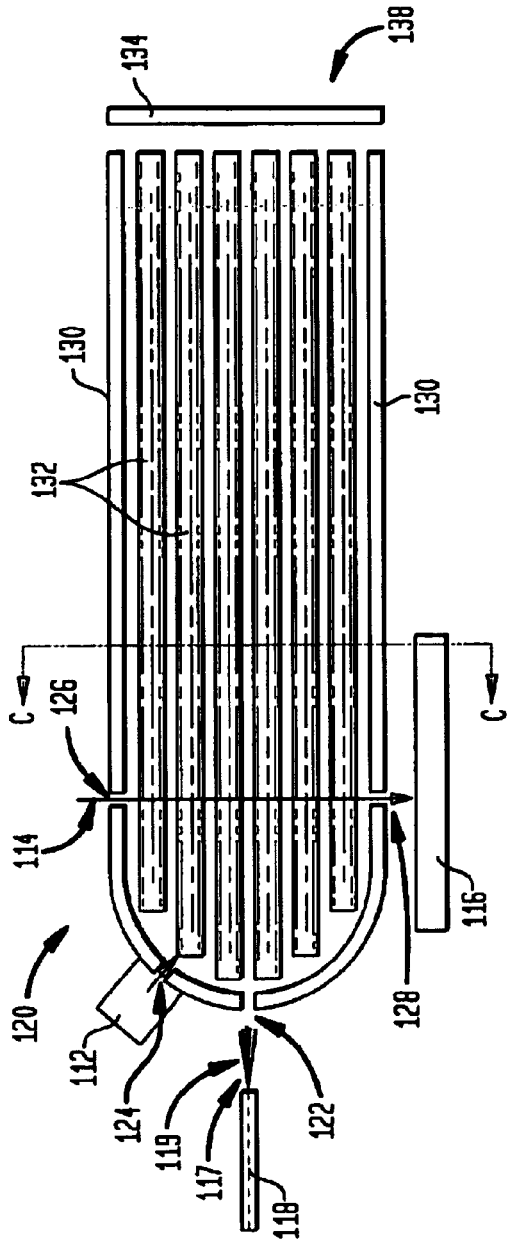
FIG. 5A depicts an alternate embodiment of the multipole ion guide of the present invention configured for use with a plurality of ion production means (e.g., EI/CI, ESI, MALDI, etc.)
Figure 5C:
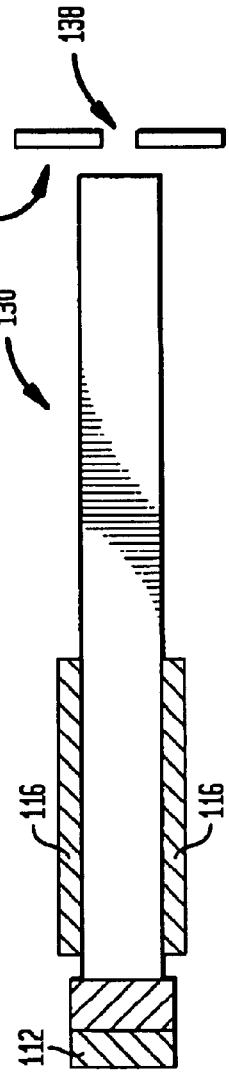
FIG. 5C shows a top plan view of the multipole ion guide shown in FIG. 5A.

Referring next to FIGS. 5A–C, shown is an alternate embodiment of the present invention configured for use with a plurality of ion production means, either separately or simultaneously. Specifically, depicted is ion guide 120 incorporating ESI ion production means 118, EI/CI ion production means 112, and MALDI ion production means 116 simultaneously. As depicted, multipole ion guide 120 preferably comprises six pairs of parallel conducting rods 132, capping electrodes 130, and gate electrode 134. Of course, any number of pairs of parallel conducting rods 132 may be used (e.g., 3, 4, 5, 6, etc.). As shown, conducting rods 132 are preferably arranged such that they are equally spaced from one another (or parallel and equidistant from a central long axis). In an alternative embodiment, conducting rods 132 may be arranged in parallel, but not equally spaced from one another. In yet another alternate embodiment, the pairs of conducting rods 132 may be positioned such that rods 132 form arcs (i.e., the spacing between rods 132 in a given pair is greater for rods 132 in the center of ion guide 120 than rods 132 at its upper and lower edges). Preferably, rods 132 all have different lengths such that at one end of the ion guide 120 all of rods 132 end approximately in a single plane enabling ion guide 120 to be "capped" at this end by a planar (or flat) end capping electrode 134. Similarly, ion guide 120 is capped longitudinally on its top and bottom by capping electrodes 130. Again, capping electrodes 130 are substantially planar (or flat) conductive electrodes, but because conducting rods 132 are preferably of different lengths, having a first end approximately in a single plane, ion guide 120 preferably has conducting rods 132 forming a second end not in a single plane. That is, conducting rods 132 at the center of ion guide 120 are preferably longest, with conducting rods 132 progressively getting shorter towards the top and bottom edges of ion guide 120. Preferably, conducting rods 132 are of such lengths that when positioned in parallel, a side view of ion guide 120 depicts the second end of rods 132 forming a generally semicircular shape. In such an embodiment, top and bottom capping electrode 130 has a generally curved portion which conforms to the shape of the second end of ion guide 120 formed by conducting rods 132. Of course, top and bottom capping electrode 130 is such that opening 122 remains at the second end of ion guide 120 for introduction of the ions into ion guide 120. Specifically, the entrance end of ion guide 120, top and bottom capping electrode 130 extends continuously around the second end of conducting rods 132.

For example, sample ions enter ion guide 120 through aperture (or opening) 122 and exit ion guide 120 through exit electrode 134. Preferably, high voltage RF potentials are applied to conducting rods 132, with top and bottom capping electrode 130 being held at a repulsive DC potential to "force" the ions toward the center of ion guide 120.

Figure 7:
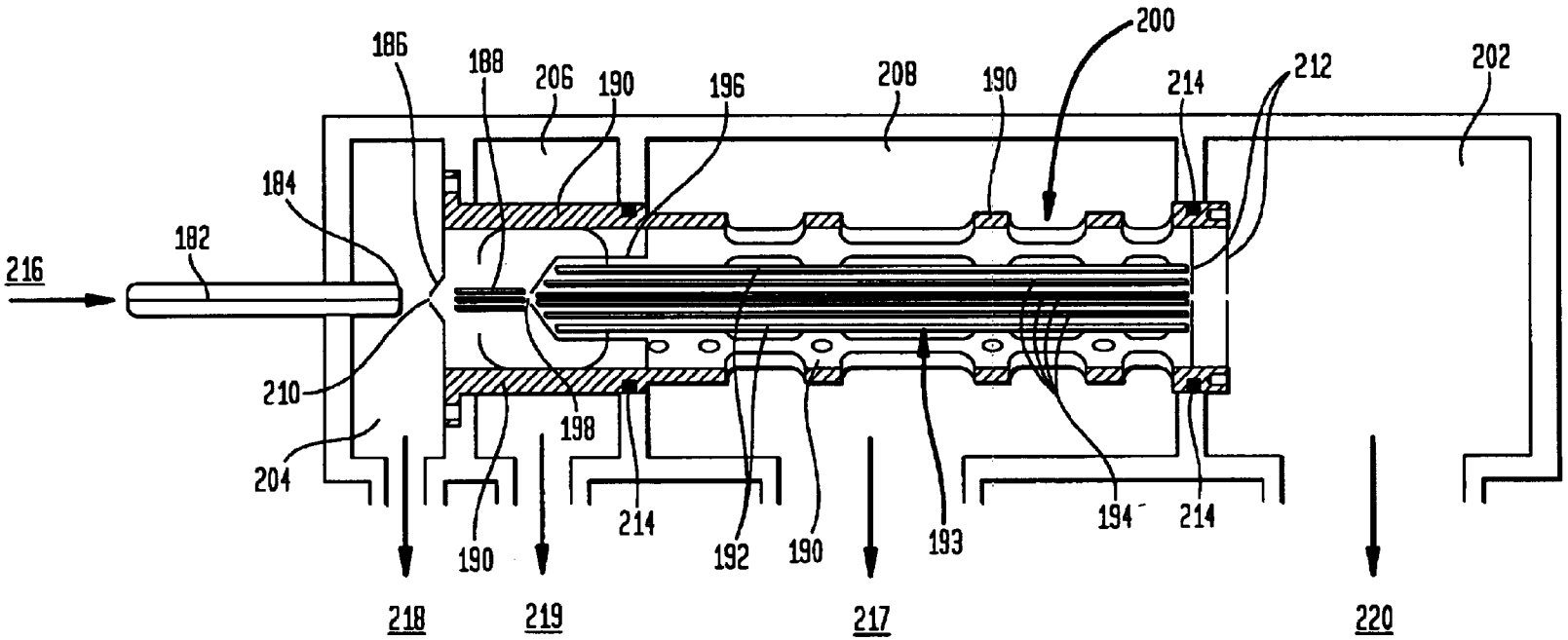
FIG. 7 is a schematic representation of an internal side view of the preferred embodiment of the RF-DC ion guide assembly according to the present invention as it is incorporated into the multiple stage pumping region of a mass spectrometer.

First, regarding ESI ion production means 118, the ions enter ion guide 120 through aperture 122 in capping electrode 130. As with conventional ESI, sample solution is sprayed from a sprayer (not shown) such that a spray of fine droplets of sample solution exits a spray needle (not shown) of the sprayer. Due to an electrical potential between the spray needle and the entrance end (not shown) of capillary 118, the fine droplets of sample solution are ionized. The formed analyte ions then enter capillary 118 through an opening in the entrance end, and the ions are transported through a channel within capillary 118 to exit end 117 of capillary 118. Upon exiting capillary 118, the ions 119 may enter ion guide 120 through aperture 122. As described above, a flow of neutral gas may be used to aid or guide the ions into ion guide 120 through aperture 122. Optionally, as shown in FIG. 7, a pre-multipole ion guide (not shown in FIG. 5A) may be positioned between capillary 118 and ion guide 120.

Second, with respect to EI/CI ion production means 112, sample ions may enter ion guide 120 through aperture 124. As shown, aperture 124 is positioned at an angle with respect to conducting rods 132 of ion guide 120. Optionally, EI/CI source may be positioned at aperture 122 in place of ESI source 118, or alternatively at aperture 126 in place of the MALDI laser 114.

Third, regarding MALDI ion production means 114/116, ions are introduced into ion guide 120 through aperture 128 when MALDI sample 116 is struck by MALDI Laser 117. The laser light passes through ion guide 120 after entering at aperture 126 and exits through aperture 128. Upon exiting aperture 128, laser beam 114 strikes MALDI sample surface 116 thereby generating sample ions which pass into ion guide 120 through aperture 128.

With each of these ionization methods, capping electrode 130 maintains a repulsive DC potential, as does gate electrode 137 at the exit end of ion guide 120. Of course, it is consistent with the invention that other types of ionization methods may be used (e.g., atmospheric pressure chemical ionization, plasma desorption, glow discharge, secondary ionization, fast atom bombardment, etc.). Also, in accordance with the invention, ions need not be accepted directly from an ion production means. Rather, ions may pass through some other device before entering the ion guide. For example, ions might be produced by an ESI source and be analyzed by ion mobility spectroscopy before entering the ion guide. Alternatively, ions may pass through a capillary device before entering the ion guide.

Turning next to FIG. 5B, shown is a cross-sectional view at line B—B of ion guide 120. As shown in FIG. 5B, the six pairs of conducting rods are aligned in parallel and adjacent to one another such that the first rod of all pairs of rods 132 lie in a first plane, while the second rod of all pairs of rods 132 lie in a second plane which is parallel to the first plane. Alternatively, conducting rods 132 may not lie in a single plane, but rather may be positioned in an arc-like formation, an angled formation, or some other desired configuration. In addition, as shown in FIG. 5B, capping electrode 130 includes circular opening 122 to provide for the introduction of ions into guide 120 from source 118. Similarly, openings 124, 126 and 128 are preferably circular apertures to provide for the introduction of sample ions from EI/CI ion production means 112, laser beam 114 to ionize samples on MALDI sample 116, and sample ions from MALDI sample 116, respectively. Alternatively, openings 122, 124, 126 and 128 may be any shape (i.e., square, triangular, rectangular, hexagonal, etc.)

An alternate embodiment (not shown) of ion guide 120 comprises multiple capping electrodes. That is, capping electrode 130 as shown in FIG. 5A may comprise five parts, with a space or gap between each part. These spaces provide the same functions as openings 122, 124, 126 and 128 in FIG. 5A. Of course, this embodiment would require that each part of the capping electrode be attached to a power source such that the appropriate potentials may be applied thereto. In addition, capping electrode 130 may comprise fewer than five parts—for example, it may comprise a top electrode, a bottom electrode, and an end electrode. In this embodiment, openings 126 and 128 are formed from the space or gap between the top electrode and end electrode, respectively. Openings 122 and 124 may then comprise circular (or some other shape) apertures. Again, each part (i.e., top, bottom and end) of the capping electrode must be connected to a power supply for application of the appropriate potentials.

Next, as with FIG. 4C above, FIG. 5C shows a top plan view of ion guide 120. Ion guide 120 has at its exit end gate electrode 134, gate electrode 134 preferably comprising an opening (or aperture) for allowing ions to pass out of ion guide 120 when gate electrode 134 is deenergized. Alternatively, gate electrode 134 may comprise a grid electrode. Preferably, gate electrode 134 is held comprising two parallel electrodes spaced apart such that ions may pass there through when the electrodes are deenergized. Alternatively, gate electrode 134 may be a planar electrode at a repulsive DC potential until such time that the ions are to be released from ion guide 120 to the next stage of the mass spectrometer (e.g., the mass analyzer). Repulsion of the ions from the DC potentials on top and bottom capping electrode 130 and gate electrodes 134 in conjunction with the RF potential applied to conducting rods 132 may be used to trap ions within ion guide 120 for any length of time (i.e., to allow for sufficient cooling of the ions, to better focus the ions, etc.) prior to entering the mass analyzer.

Figure 6:
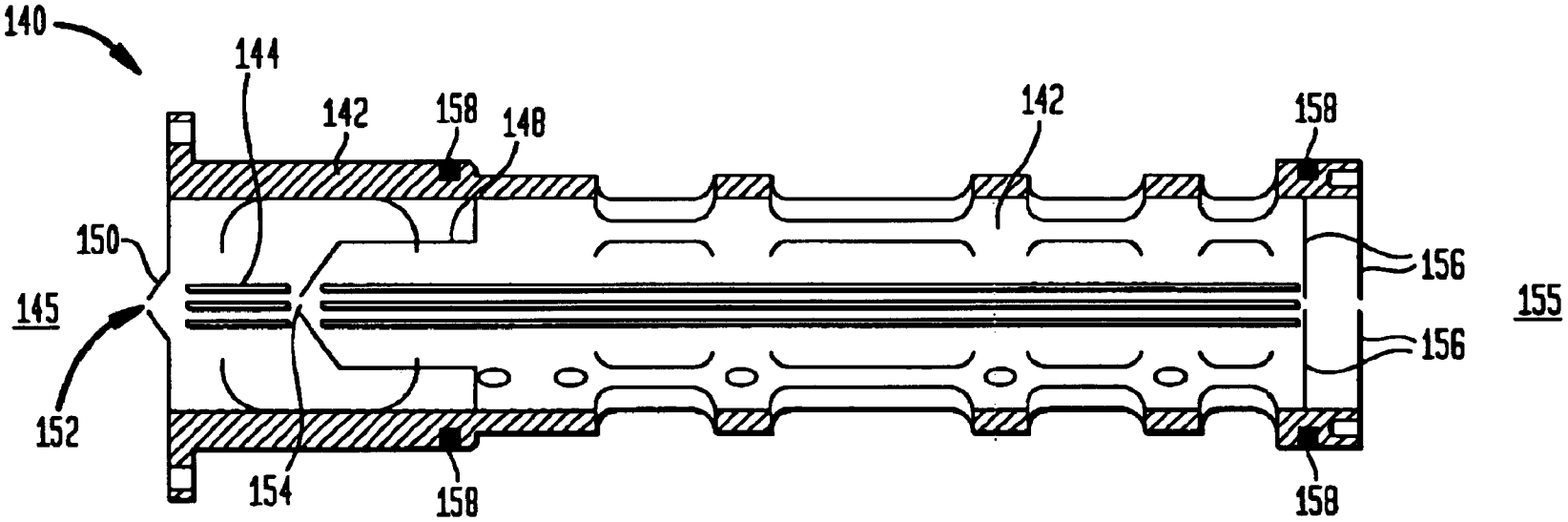
FIG. 6 shows an internal side view of a multipole ion guide according to co-pending application Ser. No. 09/636,321.

Turning now to FIG. 6, shown is multipole ion guide assembly 140, as described in co-pending application Ser.

No. 09/636,321. As depicted, multipole ion guide assembly 140 disclosed therein comprises skimmers 148 & 150, pre-multipole 144, multipole 146, and exit electrodes 156. As shown, multipole ion guide assembly 140 is positioned such that it may transfer ions from a first pumping stage 145 to mass analysis region 155, across one or more intermediate differential pumping stages.

During operation, ions may be generated from an API source (e.g., ESI or APCI) (not shown), and are introduced into first differential pumping stage 145 through an ion transport device such as a capillary. First pumping stage 145 may be pumped to a pressure lower than atmospheric pressure, for example, to a pressure of approximately 1–2 mbar. The transported ions in first pumping stage 145 are directed by an electric field into orifice 152 of first skimmer 150 and into multipole ion guide assembly 140. The electric field may be generated by application of a potential difference across , for example, a capillary's exit end and first skimmer 150. This electric field is applied such that the ions are directed toward orifice 152 of first skimmer 150, while neutral gas particles are pumped away. Optionally, this electric field may be varied depending on the desired result, the size of the ions being directed, the distance between a capillary exit end and first skimmer 150, etc. Alternatively, it is envisioned that in certain situations better results may be obtained without application of an electric field across the capillary exit end and first skimmer 150. Optionally, o-ring seals 158 may be used to provide a lateral seal between pressure regions.

The ions which pass through orifice 152 of skimmer 150 then enter a second differential pumping stage, which is further pumped by a vacuum pump (e.g., a turbo molecular drag pump). This second pumping stage may be pumped and maintained at a pressure in the range from $1\times10^{-2}$ mbar to $1\times10^{-1}$ mbar. At this point, the surviving ions enter pre-multipole 144, which may be operated as an RF only ion guide, wherein the ions are further separated from any neutral gas molecules. Pre-multipole 144 may comprise a plurality of electrode rods, each having a potential applied thereto such that the resulting electric field "pushes" or forces the ions toward a central axis as the ions continue to move through pre-multipole 144 toward a second skimmer 148 (which leads to yet another pumping stage). The ions then pass through second skimmer 148, while the neutral gas molecules, which are not affected by the electrical field, are pumped away. In one configuration, pre-multipole 144 is positioned between first skimmer 150 and second skimmer 148, and is located entirely in a second differential pumping stage. Of course, alternative configurations may be used. For example, pre-multipole 144 may be positioned to cross from one pumping stage to another, one or both skimmers may be removed, or one or both skimmers may be replaced with focusing lenses (e.g., Einsel lenses, etc.).

As the ions pass through second skimmer 148, they enter yet another (third) pumping stage and multipole 146. This third pumping stage may be pumped to and maintained at a pressure in the range from $1\times10^{-3}$ mbar to $1\times10^{-2}$ mbar. At this point, the surviving ions enter multipole 146, which may be operated as an RF only ion guide, wherein the ions are further separated from any neutral gas molecules. As described in co-pending application Ser. No. 09/636,321, multipole 146 may comprise a plurality of electrodes, each having an electric potential applied thereto such that the resulting electric field "pushes" or forces the ions toward a central axis of multipole 146. Again, application of the electric field may separate the ions from other neutral gas molecules present (which are pumped away because they are not affected by the electrical field). That is, neutral gas molecules will be continuously pumped away by the connected pump (not shown) (e.g., a turbo molecular drag pump). In addition, the introduction or presence of collisional gas into the third pumping stage results in the collisional cooling of the ions within multipole 146 as the ions are being "guided" therethrough. The cooled ions then pass through exit electrodes 156 as they are introduced into mass analysis region 155 for subsequent mass analysis. Mass analysis region 155 may comprise any of a number of mass analysis devices, including but not limited to time-of-flight (TOF), quadrupole (Q), Fourier transform ion cyclotron resonance (FTICR), magnetic (B), electrostatic (E) or quadrupole ion trap analyzers.

In an embodiment of the multipole ion guide assembly 140 (as described in co-pending application Ser. No. 09/636,321, multipole 146 is positioned between second skimmer 148 and exit electrodes 156 (which lead to mass analysis stage 155), with multipole 146 being positioned within the third pumping stage. Of course, alternate configurations are described, such as, multipole 146 being positioned across multiple pumping stages, skimmer 148 or exit electrodes 156 being removed or replaced by other elements such as focusing lenses (e.g., Einsel lenses, etc.).

In addition, the preferred embodiment of multipole ion guide assembly 140 (as set forth in co-pending application Ser. No. 09/636,321) includes pre-multipole 144 positioned between first and second skimmers (150 & 148, respectively) to separate the ions from any existing neutral gas molecules prior to the ions entering multipole 146. In addition, pre-multipole 144 may focus ions onto the center of second skimmer 148 while the neutral gas molecules are pumped away. Efficient differential pumping in the pumping stages allows multipole 146 (the main ion guide) to be in a pressure region having a pressure which is both low enough for ion trapping and high enough for collisional cooling. Multipole ion guide assembly 140 may be used in applications requiring either ion trapping (for a specific period of time), ion selecting, ion fragmenting, etc. For instance, if the pressure in the region containing multipole 146 is too high, ions may be scattered or fragmented. In a single skimmer system, the effects of this scattering or fragmenting are difficult to manage. The presence of more than one skimmer along with short pre-multipole 144 minimizes scattering and fragmentation of the sample ions.

Also as shown, multipole ion guide assembly 140 may comprise housing 142 in which first skimmer 150, second skimmer 148, pre-multipole 144, multipole 146, and exit electrodes 156 are all secured in longitudinal alignment. These ion optic elements are all maintained in longitudinal alignment with each other such that ions may be transported on a single axis through each optical component of multipole ion guide assembly 140 from the ion production region (or first pumping region 145) to the mass analyzer in mass analysis region 155. Housing 142 may be made from any rigid and durable material, such as aluminum.

Within housing 142, skimmers 150 and 148, pre-multipole 144, multipole 146 and exit electrodes 156 all may be secured by insulating holders. These insulating holders may provide electrical insulation for each component from housing 142, as well as from each other. In addition, these insulating holders secure skimmers 150, 148, pre-multipole 144, multipole 146 and exit electrodes 156 all in longitudinal alignment within housing 142.

During operation of multipole ion guide assembly 140, as shown in FIG. 6, sample ions are first introduced through orifice 152 of skimmer 150 (as discussed above) and enter a first pumping stage and pre-multipole 144. While, in pre-multipole 144, the ions are separated from any existing neutral gas molecules, and are transported longitudinally therethrough. That is, an electric field, which is generated through the application of potentials to the rods of pre-multipole 144, forces the ions towards the center axis of pre-multipole 144 as the ions move longitudinally therethrough. The electric field has no effect on the neutral gas molecules, such that substantially all of these molecules are not transported through or directed through pre-multipole 144.

Once transported through pre-multipole 144, the sample ions are introduced through orifice 154 of skimmer 148 (as discussed above) and into a second pumping stage and multipole 146. While in multipole 146, the ions are further separated from any existing neutral gas molecules, are trapped, collisionally cooled, selected, fragmented, scattered, etc. (as discussed above), and are transported longitudinally therethrough. At the exit end of multipole 146, the selected (or fragmented, etc.) sample ions pass through exit electrodes 156 where the ions may be accelerated into a mass analyzer for subsequent analysis.

Regarding multipole ion guide assembly 140 shown in FIG. 6, it is important that the insulating holders and housing 142 maintain the electrical independence of skimmers 150 & 148, pre-multipole 144, multipole 146, and exit electrodes 156, even though such components are secured in longitudinal alignment within housing 142. For instance, individual components, and also individual elements within the individual components, may require application of separate and/or different electrical potentials for optimum performance. Therefore, it is important that the electrical independence of each component is maintained. However, in other embodiments, certain components (i.e., skimmer 150 and skimmer 148) of multipole ion guide assembly 140 may be in electrical contact with one another such that the same electric potentials may be applied to each through a single connection to a power source.

Referring next to FIG. 7, depicted is multipole ion guide assembly 200, which incorporates the preferred embodiment of ion guide 193 according to the invention, as it is incorporated into the multiple stage pumping region of a mass spectrometer. Such a system includes multipole ion guide assembly 200, capillary 182, first, second and third differential pumping stages 204, 206 & 208, each of which being connected to a vacuum pump (e.g., roughing pump 218 and a turbo pump having drag stage 219 & main stage 217, respectively, and mass analysis region 202, which is connected to a second turbo pump 220. Alternatively, a single pump or pumping system may be used in accordance with the invention. Also, shown is ion guide 193 configured for use with a conventional mass spectrometer using an ESI ion production means. Specifically, ions are produced from a sample material and a sample solution enters ionization region 216 through a spray needle, at the end of which the sample solution is formed into a spray of fine droplets. This spray is formed as a result of an electrostatic field applied between the spray needle and the sampling orifice of capillary 182. Alternatively, the sampling orifice may be an aperture or other similar inlet leading into the vacuum regions of the mass spectrometer. Due to the applied electrostatic field, electrosprayed droplets evaporate while in the ionization region thereby producing gas phase analyte ions which enter the sampling orifice of capillary 182. Optionally, heated drying gas may be used to assist the evaporation of the droplets and passage of ions into capillary 182. Thus, some of the analyte ions are carried with the gas from the ionization region through capillary 182 and into first vacuum region 204 of the mass spectrometer.

Similar to that described above for FIG. 6, multipole ion guide assembly 200 comprises skimmers 186 & 196, pre-multipole 188, RF-DC ion guide 193, and exit electrodes 212. As depicted in FIG. 7, multipole ion guide assembly 200 is positioned such that it may transfer ions from ion source region 216 to mass analysis region 202, across one or more differentially pumped regions of a mass spectrometer.

During operation, ions may be generated from an API ion production means (e.g., ESI or APCI) (not shown), and are introduced into first differential pumping region 204 through an ion transport device such as a capillary. Alternatively, ions may enter region 204 directly from an ion production means. This first region 204 is preferably pumped to a pressure lower than atmospheric pressure by vacuum pump 218—for example, region 204 may be pumped to a pressure of approximately 1–2 mbar. Once within region 204, the transported ions are directed by an electric field into orifice 210 of first skimmer 186 and into multipole ion guide assembly 200. The electric field may be generated by application of a potential difference across, for example, capillary exit end 184 and first skimmer 186. Alternatively, the electric field may be generated by application of a potential difference across an ion source (e.g., a spray needle) and first skimmer 186. This electric field may be applied such that the ions are directed toward orifice 210 of first skimmer 186, while neutral gas particles are pumped away. Optionally, this electric field may be varied depending on the desired result, the size of the ions being directed, the distance between capillary exit 184 (or some other element) and first skimmer 186, etc. Alternatively, it is envisioned that in certain situations better results may be obtained without application of the electric field across capillary exit 184 and first skimmer 186.

The ions that pass through first skimmer 186 then enter second differential pumping region 206, which is further pumped by vacuum pump 219 (e.g., a turbo molecular drag pump) to a lower pressure region, preferably, in the range from $1\times10^{-2}$ mbar to $1\times10^{-1}$ mbar. Here, the surviving ions may enter pre-multipole 188, preferably operated as an RF only ion guide, wherein the ions are further separated from any neutral gas molecules. The preferred embodiment of pre-multipole 188 is described fully in co-pending application Ser. No. 09/636,321, which is herein incorporated by reference. Generally, though, pre-multipole 188 comprises a plurality of electrode rods, each having a potential applied thereto such that the resulting electric field "pushes" or "forces" the ions toward a central axis as the ions continue to move through pre-multipole 188 toward orifice 198 of skimmer 196 (which leads to yet another pumping region).

The ions then pass through second skimmer 196, while the neutral gas molecules, which are not affected by the electrical field, are pumped away. In the preferred embodiment, pre-multipole 188 is positioned between first skimmer 186 and second skimmer 196, and is located entirely in first differential pumping region 204. Of course, alternative arrangements may be used. For example, pre-multipole 188 may be positioned to cross from one pumping stage to another (i.e., from first pumping region 204 into second pumping region 206), one or both skimmers may be removed, or one or both skimmers may be replaced with focusing lenses (e.g., Einsel lenses, etc.).

Once through orifice 198 of second skimmer 196, the ions preferably enter third pumping region 208 where they also enter RF-DC ion guide 193. Preferably, this third pumping region 208 is pumped to and maintained at a pressure in the range from $1\times10^{-3}$ mbar to $1\times10^{-2}$ mbar. Here, the surviving ions enter ion guide 193, preferably operated as an RF-DC ion guide, wherein the ions are further separated from any neutral gas molecules. As described herein above with respect to FIGS. 4A–4C, ion guide 193 preferably comprises six pairs of parallel conducting rods 194 (although only four pairs are shown in FIG. 7), capping electrodes 192, and gate electrodes 212. Of course, any number of pairs of parallel conducting rods may be used (e.g., 3, 4, 5, 6, etc.). As specifically shown in FIG. 4B, each pair of conducting rods 194 is preferably arranged such that it is equally spaced from its immediately adjacent pair (and parallel and equidistant from a central long axis). In an alternative embodiment, conducting rods 194 may be arranged in parallel, but not equally spaced from one another. In yet another alternate embodiment, the pairs of conducting rods 194 may be positioned such that rods 194 form arcs (i.e., the spacing between rods 194 in a given pair is greater for rods 194 in the center of ion guide 193 than rods 194 at its upper and lower edges). Preferably, pairs of conducting rods 194 all have different lengths such that at one end of the ion guide 193 (i.e., at its exit end) all of rods 194 end approximately in a single plane enabling ion guide 193 to be "capped" at this end by a planar (or flat) exit electrode 212. Similarly, ion guide 193 is "capped" longitudinally on its top and bottom by capping electrodes 192. Again, capping electrodes 192 are substantially planar (or flat) conductive electrodes. Because conducting rods 194 are preferably of different lengths, having a first end approximately in a single plane, ion guide 193 preferably has conducting rods 194 forming a second end which is not in a single plane. That is, conducting rods 194 at the center of ion guide 193 are preferably longest, with conducting rods 194 being shorter towards the top and bottom edges of ion guide 193.

Preferably, conducting rods 194 are of such lengths that when positioned in parallel, a side view of ion guide 193 (as shown in FIG. 7) depicts the second end of rods 194 (i.e., at its entrance end) forming a generally angular shape. In such an embodiment, top and bottom capping electrode 192 may be generally bent to conform to the shape of skimmer 196. However, as shown in FIG. 7, capping electrodes may be entirely flat (or planar) and skimmer 196 may be used to "cap" the entrance end of ion guide 193. Alternatively, conducting rods 194 may be of such lengths that when positioned in parallel, a side view of ion guide 193 depicts the second end of rods 194 (i.e., at its entrance end) forming a generally semicircular shape (see FIG. 5), flat shape, reverse angular shape (i.e., where the central conducting rods 194 are shorter the upper and lower conducting rods 194), etc. Of course, the top and bottom capping electrodes 192 would be modified accordingly to correspond to the shape of the arrangement of conducting rods 194.

During operation, sample ions enter ion guide 193 through orifice 198 of skimmer 196 and exit ion guide 193 through exit electrodes 212. Preferably, high voltage RF potentials are applied between conducting rods 194, with top and bottom capping electrode 192 being held at a repulsive DC potential to "force" the ions toward the central axis (i.e., the longitudinal axis) of ion guide 193. Application of the electric field separates the ions from other neutral gas molecules present (which are pumped away because they are not affected by the electrical field). That is, neutral gas molecules will be continuously pumped away by vacuum pump 217 (not shown) (e.g., a turbo molecular drag pump). In addition, the introduction (or presence) of collisional gas in third pumping region 208 (i.e., where ion guide 193 is located) results in the collisional cooling of the ions within ion guide 193 as the ions are being "guided" therethrough. The cooled ions then pass through exit electrodes 212 as they are introduced into mass analysis region 202 for subsequent mass analysis. Mass analysis region 202 may comprise any of a number of mass analysis devices, including but not limited to time-of-flight (TOF), quadrupole (Q), Fourier transform ion cyclotron resonance (FTICR), magnetic (B), electrostatic (E), or quadrupole ion trap analyzers.

In the preferred embodiment of the invention, ion guide 193 is positioned between second skimmer 196 and exit electrodes 212 (which lead to mass analysis region 202), with ion guide 193 being entirely positioned within a single pumping region (here it is the third region). Of course, alternative configurations may be used, including but not limited to, for example, ion guide 193 being positioned across multiple pumping stages, skimmer 196 or exit electrodes 212 being removed or replaced by other elements such as focusing lenses (e.g., Einsel lenses, etc.), etc.

As demonstrated in FIG. 7, the preferred embodiment of ion guide 193 is used in multipole ion guide assembly 200, which includes pre-multipole 188 comprising short (e.g., 8–20 mm) electrodes between first and second skimmers (186 & 196, respectively) to separate the ions from any existing neutral gas molecules prior to the ions entering ion guide 193. In addition, pre-multipole 188 may "focus" ions onto orifice 198 of second skimmer 196 while the neutral gas molecules are pumped away. Efficient differential pumping in the pumping regions allows ion guide 193 to be in a pressure region having a pressure which is both low enough for ion trapping and high enough for collisional cooling. Therefore, ion guide 193 according to the present invention may be used in applications requiring either ion trapping (for a specific period of time), ion selecting, ion fragmenting, etc. For instance, if the pressure in the region containing ion guide 193 is too high, ions may be scattered or fragmented. In a single skimmer system, the effects of this scattering or fragmenting are difficult to manage. Conversely, when using ion guide assembly 200, the presence of more than one skimmer along with short pre-multipole 188 minimizes scattering and fragmentation of the sample ions.

Also as shown in FIG. 7, multipole ion guide assembly 200 comprises housing 190 in which first skimmer 186, second skimmer 196, pre-multipole 188, ion guide 193, and exit electrodes 212 are all secured in longitudinal alignment. These ion optic elements are all maintained in longitudinal alignment with each other such that ions may be transported on a single axis through each optical component of multipole ion guide assembly 200 from the region 216 (i.e., an ion source region, a first pumping region, etc.) to the mass analyzer in mass analysis region 202. Preferably, housing 190 is made from a rigid and durable material, such as aluminum, although certain other metal or plastic materials may be used. Optionally, o-ring seals 214 may be used to provide a lateral seal between pumping regions 204, 206, 208 and 202.

Within housing 190, skimmers 186 & 196, pre-multipole 188, multipole 193 and exit electrodes 212 are all preferably secured in longitudinal alignment by insulating holders (not shown). These insulating holders preferably provide electrical insulation for each component from housing 190, as well as from each other.

In a preferred operation of multipole ion guide assembly 200 as shown in FIG. 7, sample ions are first introduced through orifice 210 of skimmer 186 (as discussed above)

into pumping region 204 containing pre-multipole 188. While within pre-multipole 188, the ions are separated from any existing neutral gas molecules, and are transported longitudinally therethrough. That is, an electric field, which is generated through the application of potentials to the rods of pre-multipole 188, forces the ions towards the center axis of pre-multipole 188 as the ions move longitudinally therethrough. The electric field has no effect on the neutral gas molecules, such that substantially all of these molecules are not transported through or directed through pre-multipole 188.

After passing through pre-multipole 188, ions are introduced through skimmer 196 (as discussed above) into second pumping region 206 and ion guide 193. As previously described herein regarding FIGS. 4A–4C, while in ion guide 193, the ions are further separated from any existing neutral gas molecules, are trapped, collisionally cooled, selected, fragmented, scattered, etc. (as discussed above), and are transported longitudinally therethrough. At the exit end of ion guide 193, the selected (or fragmented, etc.) sample ions pass through exit electrodes 212 where the ions may be accelerated into a mass analyzer for subsequent analysis.

In multipole ion guide assembly 200, which incorporates the preferred embodiment of ion guide 193 according to the present invention, as shown in FIG. 7, it is important that the insulating holders and housing 190 maintain the electrical independence of skimmers 186 & 196, pre-multipole 188, ion guide 193 and exit electrodes 212, even though such components are secured in longitudinal alignment within housing 190. This is because individual components, and also individual elements within the individual components, may require application of separate and/or different electrical potentials for optimum performance. For example, regarding ion guide 193, different potentials are preferably applied to conducting rods 194 than are applied to capping electrodes 192. Therefore, it is preferred that the electrical independence of each component is maintained. However, in an alternative embodiment certain components (i.e., skimmer 186 and skimmer 196) of multipole ion guide assembly 200 may be in electrical contact with one another such that the same electric potentials may be applied to each with a single connection to a power source.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A multipole ion guide for a mass spectrometer comprising:

at least one pair of conducting rods aligned in parallel, each pair being equally spaced from one another;

at least one capping electrode comprising at least one opening and bounding said conducting rods;

means for applying RF/DC potentials to said conducting rods; and means for applying a DC potential to said capping electrodes.

2. A multipole ion guide according to claim 1, wherein said at least one capping electrode comprises a plurality of openings.

3. A multipole ion guide according to claim 2, wherein at least one of said openings accepts sample ions.

4. A multipole ion guide according to claim 2, wherein at least one of said openings provides access through said ion guide for a laser beam to ionize a sample material.

5. A multipole ion guide according to claim 1, wherein said ion guide focuses sample ions.

6. A multipole ion guide according to claim 1, wherein said apparatus traps sample ions therein for ion selection.

7. A multipole ion guide according to claim 1, wherein said apparatus traps sample ions therein for ion fragmentation.

8. A multipole ion guide according to claim 1, wherein each said conducting rod is positioned equidistant from a vertical axis.

9. A multipole ion guide according to claim 1, wherein said apparatus transfers sample ions from an ionization region to a mass analysis region.

10. A multipole ion guide according to claim 9, wherein said mass analysis region comprises a mass analyzer.

11. A multipole ion guide according to claim 10, wherein said mess analyzer selected from the group consisting of a time-of-flight mass analyzer, a quadrupole mass analyzer a quadrupole ion trap mass analyzer, a Fourier transform ion cyclotron resonance mass analyzer and an ion mobility mass analyzer.

12. A multipole ion guide according to claim 9, wherein said ionization region comprises an ion production means.

13. A multipole ion guide according to claim 12, wherein said ion production means is selected from the group consisting of atmospheric pressure chemical ionization, electrospray ionization, matrix-assisted laser desorption/ionization, secondary ionization and fast atom bombardment.

14. A multipole ion guide for analyzing chemical species, wherein said multipole ion guide comprises:

a plurality of conducting rods and at least one capping electrode comprising at least one opening and bounding said conducting rods; and means for applying voltages to said ion guide;

wherein said ion guide accepts sample ions from at least one ion production region, and wherein said ion guide transfers said sample ions to an analysis region through a plurality of vacuum stages.

15. A multipole ion guide according to claim 14, wherein at least one of said capping electrodes comprises at least one opening.

16. A multipole ion guide according to claim 15, wherein at least one of said openings accepts said sample ions from at least one said ionization region.

17. A multipole ion guide according to claim 15, wherein at least one of said openings provides access through said ion guide for a laser beam to ionize a sample material.

18. A multipole ion guide according to claim 14, wherein said ion guide focuses sample ions.

19. A multipole ion guide according to claim 14, wherein said ion guide traps sample ions therein for ion selection.

20. A multipole ion guide according to claim 14, wherein said ion guide traps sample ions therein for ion fragmentation.

21. A multipole ion guide according to claim 14, wherein each said conducting rod is positioned equidistant from a vertical axis.

22. A multipole ion guide according to claim 14, wherein said analysis region comprises a mass analyzer.

23. A multipole ion guide according to claim 22, wherein said mass analyzer is selected from the group consisting of an ion mobility analyzer, a time-of-flight mass analyzer, a quadrupole mass analyzer, a quadrupole ion trap mass analyzer, and a Fourier transform ion cyclotron resonance mass analyzer.

24. A multipole ion guide according to claim 14, wherein said ion production region comprises an ion production means.

25. A multipole ion guide according to claim 24, wherein said ion production means is selected from the group consisting of electrospray ionization, atmospheric pressure chemical ionization, matrix assisted laser desorption/ionization, glow discharge, secondary ionization and fast atom bombardment.

26. A method for analyzing chemical species in a mass spectrometer comprising an ion production means, at least one multipole ion guide, a vacuum system, and a mass analyzer, said method comprising the steps of:

(a) producing ions in an ion production region;

(b) introducing said ions into an ion guide, said ion guide comprising a plurality of conducting rods and at least one capping electrode comprising at least one opening and bounding said conducting rods;

(c) applying a first potential to said conducting rods such that said ions move to a central axis of said ion guide;

(d) transferring said ions from said ion guide into a mass analysis region; and (e) conducting mass analysis of said ions.

27. A method according to claim 26, wherein said ions are produced from a plurality of said ion production means.

28. A method according to claim 26, wherein gas phase chemical reactions occur within the ion guide.

29. A method according to claim 26, wherein ion selection occurs within said ion guide.

30. A method according to claim 26, wherein ion fragmentation occurs within said ion guide.

31. A method according to claim 26, wherein said ions are transferred from said ion guide into a second ion guide before entering said mass analysis region.

32. A method according to claim 26, wherein said method further comprises the step of: (c') applying a second potential to said capping electrode to create an electric field to trap said ions within said ion guide.

33. A method according to claim 26, wherein said capping electrode is an electrode rod.

34. A method according to claim 26, wherein said capping electrode is an electrode plate.

35. A multipole ion guide according to claim 14, wherein said capping electrode is an electrode rod.

36. A multipole ion guide according to claim 14, wherein said capping electrode is an electrode plate.

37. A multipole ion guide according to claim 1, wherein said capping electrode is an electrode rod.

38. A multipole ion guide according to claim 1, wherein said capping electrode is an electrode plate.

* * * * *